United States Patent [19]

Savajols

[11] Patent Number: 4,746,409

[45] Date of Patent: May 24, 1988

[54] PROCESS FOR STOPPING AND RESTARTING AN ELECTROLYTIC REFINING INSTALLATION

[75] Inventor: Armand Savajols, Le Palais Sur Vienne, France

[73] Assignee: Compagnie Generale d'Electrolyse du Palais, Paris, France

[21] Appl. No.: 65,388

[22] Filed: Jun. 23, 1987

[30] Foreign Application Priority Data

Jun. 25, 1986 [FR] France ..... 86 09409

[51] Int. Cl.[4] ..... C25C 1/12

[52] U.S. Cl. ..... 204/107

[58] Field of Search ..... 204/107, 108, 109

[56] References Cited

U.S. PATENT DOCUMENTS 1,614,668 1/1927 Greenawalt ..... 204/108

*Primary Examiner*—R. L. Andrews

*Attorney, Agent, or Firm*—Dennison, Meserole, Pollack & Scheiner

[57] ABSTRACT

The present invention concerns a process for stopping for a prolonged period and restarting a series of tanks for the electrolytic refining of copper. The process comprises preparing for the stoppage by reducing the proportion of $Cu^{2+}$ ions in the electrolyte, controlling the additive agents, regulating the level of the electrolyte, and slow crystallization of $CuSO_4$ in the form of very fine crystals. Subsequent restarting comprises restoration of the circulation of the electrolyte with progressive heating, a progressive increase in the electrolysis current strength, and resumption of the addition of additives. Use of the invention makes it possible to obtain deposits of refined copper of commercial quality as from the first electrolysis cycle.

6 Claims, No Drawings

PROCESS FOR STOPPING AND RESTARTING AN ELECTROLYTIC REFINING INSTALLATION

TECHNICAL FIELD OF THE INVENTION

The present invention concerns a process for prolonged stoppage and subsequent restarting of tanks for the electrolytic refining of copper, which process makes it possible to obtain commercial-quality metal as of the first cycle after restarting of the installation.

STATE OF THE ART

The major part of the copper which is intended for the electrical and electronic industries is subjected to a refining operation which is intended to adjust the level of purity thereof to at least 99.90% (being the quality referred to as HC : high conductivity). That purification operation which makes it possible to remove the usual impurities such as Ag, As, Au, Pb, Ni, Co, Sn, Se, Te, An, Bi and Fe is effected by electrolysis with a soluble anode, in an electrolyte based on copper sulphate and sulphuric acid, which is maintained at approximately 60° C. by auxiliary heating, under a current density of the order of 300 A/m2. Certain impurities go into the muds (Ag, Au, Pb, Sn, Se, Te, etc.), while others such as Ni, As and Co remain dissolved in the electrolyte, only the copper being deposited at the cathode, at a level of purity which can attain 99.95%. The quality of the cathodic deposit is substantially improved by a continuous addition to the electrolyte of organic substances and in particular gelatine and thio-urea, as well as chlorine (which is introduced in the form of HCl).

The crude copper to be refined is introduced into the tanks in the form of anodic plates which are several centimetres in thickness and whose operating life may be for example of the order of around twenty days.

The refined copper is deposited on thin cathodic sheets which are referred to as "starting sheets" in the form of a solid compact deposit which progressively increases in thickness. When the anode is at the halfway stage of its operating life (for example 10 days), a first operation of collecting the cathodes is carried out, and the cathodic starting sheets are renewed. The exhausted anodes are recycled to a foundry.

The cathode starters or starting sheets are produced in special electrolysis sections (which sections are referred to as "strippers") in which the cathodes are plates of rolled copper (mother plates), on the two faces of which a thin deposit of copper (0.8 mm) is produced.

After around twenty hours of residence time in the tank, that deposit is pulled off (stripping) and thin sheets are obtained, which are planed and secured to be suspended in a tank.

The electrolyte is kept circulating in the tanks. The intake of the liquors takes place at the tank head and at the bottom while the outlet is at the tank bottom and at the top. The necessary temperature is maintained by a steam heating system as the Joulean effect, by virtue of the low electrolysis voltage (about 0.3 volt) is insufficient to maintain the bath at the optimum temperature of the order of 50° to 60° C.

The installation also includes a certain number of tanks referred to as "decoppering tanks".

Indeed, as the electrolysis operation takes place, the electrolyte becomes enriched with soluble impurities (Ni and As) and its concentration of copper sulphate increases. Good performance of the electrolysis operation involves keeping the copper content in the bath at a given level (40 to 45 g/l of Cu) and keeping the levels of concentration of impurities below a certain limit (10 g/l of As and Ni). It is therefore necessary continuously to purify the electrolyte and to adjust its copper content.

For that purpose, a certain proportion, for example 2/100ths of the total volume is taken off every day, and a purification operation is effected on that proportion, in succession.

In a first series of tanks, the copper is extracted by effecting an electrolysis operation using an insoluble anode (an anode consisting of lead with 6% of antimony). That is the decoppering operation. The result is cathodes of non-commercial quality which are recycled to the foundry in order to produce anodic plates.

Other tanks involve the removal of arsenic and then nickel.

An installation for the electrolytic refining of copper operates continuously. However, it may involve stoppages of greater or shorter duration, which are either programmed to occur or which are accidental: a break in the electrical power lines, failure of a rectifier, or any other technical or human deficiency.

It is known that, after a total and prolonged stoppage, the operation of restarting an electrolytic refining installation involves serious problems and that, irrespective of the precautions taken, the production corresponding to the first "cathodic cycle" is of only medium quality and necessarily has to be recycled to the foundry, which involves a substantial loss from the point of view of the operator.

SUBJECT-MATTER OF THE INVENTION

The present invention precisely concerns a process for prolonged stoppage and subsequent restarting of electrolysis tanks permitting the production of refined copper of commercial quality as from the first cathodic cycle, under conditions of full safety in regard to the personnel and the equipment.

That process is characterised by the following steps:

A. STOPPAGE

1. If the stoppage has been programmed to occur, it is preferable in the days which precede it to effect a slight reduction, about 10%,in the copper content of the electrolyte. The normal copper content being for example 45 g of $Cu^{2+}$ per liter, it is reduced to about 40 g/l (either by dilution or by passing it into a number of tanks which operate with an insoluble anode of lead with antimony for example), the copper which is extracted in that way being deposited on cathodes where it can be recovered, and the proportion of $H_2SO_4$ is also adjusted to around 180 grams per liter. In contrast, the additions of additive agents (gelatine, thio-urea and chlorine) are maintained at the normal level up to the stoppage occurring.

2. The electrolysis current, heating system and circulation of electrolyte are stopped at the same time.

3. The tanks are partially siphoned so that the level of electrolyte in each tank is slightly below the top edge of the cathodes. The cathodic bars which support and connect the array of cathodes of a tank are then washed with water and then all the tanks are covered with a plastic Nylon® film: which acts as a heat insulation. The electrolyte is then left to crystallize in the tanks.

In that way, crystallization occurs in the form of a mud of very fine crystals of $CuSO_4$ which do not cause any damage and which will be rapidly put into solution again when the installation is restarted.

4. The loose decoppering tanks are withdrawn from the circuit so that none thereof is in service at the moment at which the installation is restarted.

5. The circulating pumps are rinsed with water.

6. The tanks for the formation of cathodic starting sheets (referred to as "stripping tanks") are stopped, with the deposit of copper on the mother plates. The mother plates with their deposit (which are not stripped off) are washed with hot water and stored out of electrolyte throughout the period of the stoppage.

7. Throughout the entire period of the stoppage, care is taken to ensure that the anodes are properly immersed in the electrolyte and all the tanks in which that would not have been the case are excluded from restarting by short-circuiting.

Those measures permit a stoppage of from a month to six weeks approximately without any risk in regard to the whole of the installations.

B. RESTARTING

Restarting is an operation which takes place over a period of time, and lasts between 4 and 6 days. The successive phases involved in that operation are as follows, in the following order:

1. Restoring the circulation of electrolyte, which takes around 24 hours, without heating, and makes it possible to "break the crystallization".

2. Restoring heating of the electrolyte, which makes it possible to attain a temperature of 50° C. approximately in 48 hours.

3. Setting the compositions required for the electrolyte to the appropriate levels, by analytical verification and making any corrections that may be required.

4. Restoring electrical voltage, with a progressive increase in strength so as to attain the nominal strength in 48 hours approximately. Different technical operations accompany those four successive phases of the starting operation:

The additions of thiourea+chlorine are resumed at the normal rate at the same time as the heating system is restored to operation, the additions of gelatine are resumed at the normal rate at the same time as the restoration of electrical power, the sections where the anodes have not been permanently immersed in the electrolyte are excluded from restarting. They are progressively reintroduced after the steady-state condition has been attained, prior to the restoration of electrical power, all the electrical contacts are re-made by washing with hot water, restoration of electrical power occurs only when the following two conditions are simultaneously achieved:

an electrolyte which is perfectly homogenized in regard to composition levels, and an electrolyte at 45° Celsius.

The initial strength is fixed at less than 10% and for example from 5 to 6% of the nominal strength, that is to say 500 amperes if the normal strength is from 9 to 10 KA.

The increase in strength is linear in steps of 500 A, a few hours separating each change in level, the decoppering tanks can be introduced into the circuit if necessary as soon as the voltage of the rectifiers permits same, the mother plates are stripped of their deposit and restored to operation as soon as the conditions of electrolytic and electrical equilibrium have been attained, throughout the entire period of increasing strength, systematic visual checks on the deposits are carried out. If necessary it is possible to wash certain cathodes which have whitish deposits.

Thus, as from the 5th day or at the latest in the course of the 6th day after starting of the installation, it is possible to obtain cathodes of commercial quality which do not have to be recycled to the foundry, as was always the case when using the prior processes.

The above-indicated process for prolonged stoppage and restarting may be simplified for stoppages of shorter duration not exceeding two weeks.

In such a case:

FOR STOPPING:

An electrical stop is effected and the electrolyte is kept circulating and is also maintained at the same level in terms of its composition and temperature.

The additions of additive agents (thiourea+chlorine+gelatine) are maintained at their nominal level up to the electrical stoppage and restored at the normal rate with the restoration of current strength, throughout the stopping phase the additions of gelatine are suspended and the additions of thiourea+chlorine are maintained on the basis of two thirds of their normal value, as soon as the stoppage begins the trains of cathodes are raised on supports so that the level of the electrolyte is below the punching or stamping impressions of the cathode, that is to say the points of fixing of the cathodic plates in the true sense to the horizontal cathodic bars which support them and which provide for the supply of electrical power, the stripping tanks (production of starting cathodic plates) are stopped with the deposit of copper on the mother plates. The mother plates with their deposit (the plates are not stripped) are washed with hot water and stored out of electrolyte throughout the duration of the stoppage. When electrical restarting is effected, the mother plates are stripped of their deposit and put back into service.

ON RESTARTING:

The rise in current strength is linear in steps of 500 A (for a nominal strength of 9 to 10 KA), with a few hours between each change in level. The decoppering tanks are neutralized during the period in which the current strength is increased.

Throughout the entire period of increase in current strength, systematic visual checks on the deposits are made; if necessary it is possible to wash certain cathodes which have a whitish deposit.

The performance of this process also provides for the production of cathodes of commercial quality as from the first cathodic cycle when the duration of the stoppage is limited to a few days only.

What is claimed is:

1. In a process for the electrolytic refining of copper by electrolysis current of a predetermined nominal intensity in an installation comprising electrolysis tanks including soluble anodes of copper to be refined, cathodic plates on which the refined copper is to be deposited, and an aqueous electrolyte based on copper sulfate, sulfuric acid and additive agents of thiourea, HCl and gelatine, auxiliary heating means which maintain said electrolyte at about 50° to 60° C., means continuously circulating said electrolyte and further tanks for the formation of cathodic starting sheets from mother plates, the improvement comprising a method for stopping said electrolysis for a prolonged period and subsequently restarting said electrolysis, comprising the sequential steps of:

(a) for stopping said electrolysis, (a1) progressively reducing the $Cu^{2+}$ concentration in the electrolyte by about 10% while maintaining additions of said additive agents, (a2) simultaneously interrupting said electrolysis current, said circulation, and said heating, (a3) reducing the level of electrolyte to slightly below the top edge of the cathodic plates, and (a4) covering the electrolysis tanks with a thermal insulating lining and allowing the electrolyte to crystallize in the electrolysis tanks with formation of fine crystals of $CuSO_4$ and (b) for restarting said electrolysis, (b1) restoring circulation of the electrolyte, (b2) about 24 hours after restoring circulation of the electrolyte, restoring heating of the electrolyte and addition of thiourea and HCl additives at a normal rate, (b3) about 48 hours after restoring heating, and with an electrolyte temperature of at least about 45° C., determining the composition and homogeneity of the electrolyte and making any corrections necessary, (b4) restoring the electrolysis current at an initial intensity of less than about 10% of the nominal intensity, and simultaneously restoring addition of gelatine, and (b5) progressively increasing in steps every few hours, the intensity of the electrolysis current, each said step increase being of a value approximately equal to the intensity at which current was restored, the frequency of said step increase being such that nominal current intensity is attained about 48 hours after restoring current.

2. A process according to claim 1, wherein electrolysis current to the tanks for the formation of cathodic starting sheets (mother plates) is stopped, with a deposit of copper on the mother plates which are subsequently washed with hot water and stored out of the electrolyte throughout the entire duration of the stoppage.

3. A process according to claim 1, wherein the normal $Cu^{2+}$ concentration is about 45 grams/liter, and the reduced $Cu^{2+}$ concentration is about 40 grams/liter.

4. A process according to claim 1, wherein said initial intensity upon restoring electrolysis current is about 5 to 6% of normal strength.

5. A process according to claim 3, wherein nominal electrolysis current intensity is about 9 to 10 KA, and in restarting the electrolysis, the electrolysis current is restored at an intensity of about 500 A and progressively increased in steps of about 500 A.

6. In a process for the electrolytic refining of copper by electrolysis current of a predetermined nominal intensity in an installation comprising electrolysis tanks including soluble anodes of copper to be refined, cathodic plates on which the refined copper is to be deposited, and an aqueous electrolyte based on copper sulfate, sulfuric acid and additive agents of thiourea, HCl and gelatine, auxiliary heating means which maintain said electrolyte at about 50° to 60° C., means for continuously circulating said electrolyte and further tanks for the formation of cathodic starting sheets from mother plates, the improvement comprising a method for stopping said electrolysis for a period not exceeding about two weeks and subsequently restrating said electrolysis, comprising the sequential steps of:

(a) interrupting said electrolysis current while maintaining circulation and heating of said electrolyte, and simultaneously (a1) suspending addition of gelatine, and reducing addition of thiourea and HCl to about two-thirds of the normal amount;

(a2) raising said cathodic plates or supports so that the level of electrolyte is below punching impressions on the cathodic plates;

(a3) interrupting the formation of said cathodic sheets with a deposit of copper on said mother plates, removing the mother plates from the electrolyte, washing the mother plates with hot water, and storing the washed mother plates out of electrolyte for the duration of the stoppage; and (b) simultaneously, restoring normal addition of thiourea, HCl and gelatine, and restoring said electrolysis current initially at a level of less than about 10% of nominal intensity, and subsequently increasing the intensity of said electrolysis current every few hours in steps of a value about equal to the initial level.

* * * * *